US005802829A

United States Patent [19]

Yamanaka

[11] Patent Number: 5,802,829

[45] Date of Patent: Sep. 8, 1998

[54] STEEL CORDS FOR REINFORCING RUBBER ARTICLES AND PNEUMATIC RADIAL TIRE USING THE STEEL CORDS

[75] Inventor: Takaya Yamanaka, Kodaira, Japan

[73] Assignee: Bridgestone Corporation, Tokyo, Japan

[21] Appl. No.: 766,820

[22] Filed: Dec. 13, 1996

[30] Foreign Application Priority Data

Dec. 14, 1995 [JP] Japan ..... 7-346914
Dec. 14, 1995 [JP] Japan ..... 7-346915

[51] Int. Cl.[6] ..... D02G 3/36

[52] U.S. Cl. ..... 57/212; 57/237; 57/902; 152/527; 152/556

[58] Field of Search ..... 57/210, 211, 212, 57/218, 237, 902; 152/527, 556

[56] References Cited

U.S. PATENT DOCUMENTS 3,996,733 12/1976 Holmes ..... 57/902
4,609,024 9/1986 Yatsunami et al. ..... 57/902
4,690,191 9/1987 Kawasaki ..... 57/902
5,213,640 5/1993 Ikahara ..... 57/902
5,598,693 2/1997 Yanagisawa et al. ..... 57/212

FOREIGN PATENT DOCUMENTS 0 399 795 5/1990 European Pat. Off. .
29 41 541 A1 4/1981 Germany .
64-30398 2/1989 Japan .
6-128883 5/1994 Japan ..... 57/902

*Primary Examiner*—William Stryjewski
*Attorney, Agent, or Firm*—Sughrue, Mion, Zinn, Macpeak & Seas, PLLC

[57] ABSTRACT

A two-layered twisted steel cord for reinforcing rubber articles, comprising a core including two filaments and a sheath including six or seven filaments wound around the core, in which an average twist pitch of the core is set to be at least 30 mm, and when six filaments are used for the sheath, a ratio of diameter ds of each filament of the sheath to diameter dc of each filament of the core, [(ds/dc)×100], is set in a range of 58.0 %<ds/dc<161.5%. When seven filaments are used for the sheath, the ratio of diameter ds to diameter dc is set in a range of 47.3%<ds/dc<121.1%. The two-layered twisted steel cords are used for reinforcing rubber articles, such as a pneumatic radial tire.

18 Claims, 3 Drawing Sheets

STEEL CORDS FOR REINFORCING RUBBER ARTICLES AND PNEUMATIC RADIAL TIRE USING THE STEEL CORDS

BACKGROUND OF THE INVENTION

1. Field of the Invention

The present invention relates to steel cords for reinforcing rubber articles, which are used as reinforcing materials of rubber articles such as a pneumatic radial tire, a conveyor belt, or the like. This invention also relates to a pneumatic radial tire in which the steel cords are used as the reinforcing materials.

2. Description of the Related Art

Steel cords are used as reinforcing materials of rubber articles such as a pneumatic tire. For example, as the steel cords used in a tire for heavy-load vehicles, there have been widely used those each having a 3+9+15 structure (numeral 3 indicates the number of core filaments, and numerals 9 and 15 indicate the numbers of intermediate sheath filaments and external sheath filaments, respectively), in which filaments having the same wire diameter are twisted at different twist pitches for each layer. However, since this structure does not have clearances which allow rubber to penetrate into an inner portion of the cord, when the cord contacts water, water penetrates into a hollow portion within the cord into which rubber has not penetrated, thereby resulting in corrosion of the cord. In addition, water is passed along the hollow portion and a corroded region of the cord spreads.

In order to solve the above-described problem of corrosion, there has been disclosed, in Japanese Utility Model Application Laid-Open (JP-U) No. 64-30398, a steel cord of two- or three-layered twisted cords having a core formed with two or three filaments being paralleled with each other.

However, in the above example shown in JP-U No. 64-30398, when three or more filaments are used for the core, a space which does not in the least allow penetration of rubber is formed in the center of the core. When the steel cord as described above is used for a belt layer of a tire, water penetrates into an inner portion of the cord from a cut portion in the tire caused by traveling on a rough road, thereby resulting in corrosion of the cord. In addition, it is predicted that a drawback arises in that water propagates through the inner portion of the cord so that the corroded region spreads

SUMMARY OF THE INVENTION

A first object of the present invention is to solve the above-described problems, and to provide steel cords for reinforcing rubber articles, which can improve resistance against propagation of corrosion and productivity.

A second object of the present invention is to provide a pneumatic radial tire having improved productivity and durability by using the above steel cords as reinforcing materials.

The first object of the present invention is achieved by a two-layered twisted steel cord for reinforcing rubber articles, comprising a core including two filaments and a sheath including six or seven filaments wound around the core, wherein an average twist pitch of the core is set to be at least 30 mm, and when six filaments are used for the sheath, a ratio of diameter ds of each filament of the sheath to diameter dc of each filament of the core, $[(ds/dc)\times100]$, is set in a range of $58.0\%<ds/dc<161.5\%$, and when seven filaments are used for the sheath, the ratio of diameter ds to diameter dc is set in a range of $47.3\%<ds/dc<121.1\%$.

The steel cord of the present invention is preferably constructed in that, when six filaments are used for the sheath, a ratio of a major axis a of the steel cord to a minor axis b, $[(a/b)\times100]$, is set in a range of $100.0\%>a/b>68.4\%$, and when seven filaments are used for the sheath, the ratio of the major axis a of the steel cord to a minor axis b, $[(a/b)\times100]$, is set in a range of $100.0\%\geqq a/b>66.1\%$.

Further, the steel cord of the present invention is preferably constructed in that the diameter dc of each of filaments which form the core is set in a range of $0.10\text{ mm}\leqq dc\leqq0.40$ mm and the diameter ds of each of filaments which form the sheath is set in a range of $0.10\text{ mm}\leqq ds\leqq0.37$ mm.

Moreover, in the steel cord of the present invention, the filaments which form the core may also be provided in an untwisted manner.

The above-described second object of the present invention is achieved by a pneumatic radial tire in which the above-described steel cord is applied to a cord for forming a carcass or a belt layer.

DESCRIPTION OF THE PREFERRED EMBODIMENTS

Figure 1:
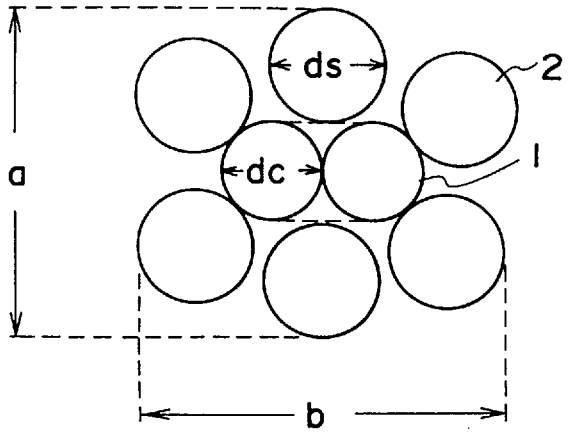
FIGS. 1 through 4 are schematic diagrams each showing a cross section of a steel cord for reinforcing rubber articles of the present invention.

In a steel cord according to the present invention, the number of filaments which form the core is limited to two. That is, in a case of a cord having the core formed of one filament, even if rubber penetrates up to the position of the core, a spiral portion into which rubber does not penetrate is formed due to filaments of a sheath being disposed biasedly. In this case, resistance against propagation of corrosion deteriorates largely as compared with the case of the cord having the core of two filaments. On the other hand, in the case of the cord having the core formed of three or more filaments, a hollow portion into which rubber does not penetrate is formed in an interior of the core, and the resistance against propagation of corrosion of the cord also deteriorates.

An average twist pitch of the core is set to be 30 mm or greater. When the pitch is less than 30 mm, it is difficult for rubber to penetrate into a clearance between filaments of the core and the productivity of stranded wires deteriorates. Here, the expression "the average pitch is 30 mm or greater" means that two filaments of the core are twisted at an angle of 360° at a distance greater than or equal to 30 mm. For example, one pitch may be formed in such a manner that the filaments are twisted at an angle of 180° at the first distance of 10 mm, are not twisted at the next distance of 10 mm, and are twisted at an angle of 180° at the last distance of 10 mm, or one pitch may be formed in such a manner that the filaments are not twisted at the first distance of 20 mm and are twisted at an angle of 360° at the remaining distance of 10 mm. Meanwhile, in a case in which the core is formed of non-twisted filaments, penetrability of rubber can be further improved and the productivity can also be remarkably enhanced. In addition, even when forming of one or combination of a wave form and a spiral form is made for one or both of filaments of the core, the effects of the present invention are not deteriorated.

In the steel cord of the present invention, when six filaments are used for the sheath, the ratio of the diameter ds of each filament of the sheath to the diameter dc of each filament which forms the core, [(ds/dc)×100], is set in the range of 58.0%≦ds/dc≦161.5%. When seven filaments are used for the sheath, the ratio is set in the range of 47.3%<ds/dc<121.1%. In the above-described respective ranges, a clearance between the adjacent filaments of the sheath, which is sufficient to allow uniform penetration of rubber in the inner portion of the cord, is maintained. Further, even when the filaments of the sheath enter the core portion, the sufficient clearance between the adjacent filaments is maintained. When set out of the ranges, the clearance between the adjacent filaments of the sheath becomes smaller and it is difficult for rubber to penetrate up to the portion of the core.

In the steel cord of the present invention, when six filaments used are for the sheath, the ratio of a minor axis a to a major axis b of the cord, [(a/b)×100], is preferably set in the range of 100.0%≧a/b≧68.4%, and when there are seven filaments, the ratio is preferably set in the range of 100.0%≧a/b≧66.1%. In the case of the steel cord which forms a belt layer of a pneumatic radial tire of the present invention, when the ratio of the minor axis a to the major axis b of the cord is set in the above-described respective ranges, even if a cut is formed in a tire cord due to the tire being driven on a rough road, corrosion of the cord is not apt to propagate. Further, when the ratio is set out of the ranges and the cut is formed in the tire cord due to the tire being driven on a rough road, corrosion of the cord is apt to propagate.

Further, the preferred range of diameter dc of each filament for forming the core is 0.10 mm≦dc≦0.40 mm and the preferred range of diameter ds of each filament for forming the sheath is 0.10 mm≦ds≦0.37 mm. When diameters dc, ds are made smaller than the respective lower limit values, manufacturing of the filaments becomes extremely difficult. When they are set to be greater than the respective upper limit values, in a process in which a tire member is manufactured by coating the cord by a rubber sheet, the filament plastically deforms and a warp is thereby formed in the tire member. As a result, the productivity deteriorates.

[EXAMPLES]

Referring now to the experimental examples described below, the present invention will be described concretely.

Figure 2:
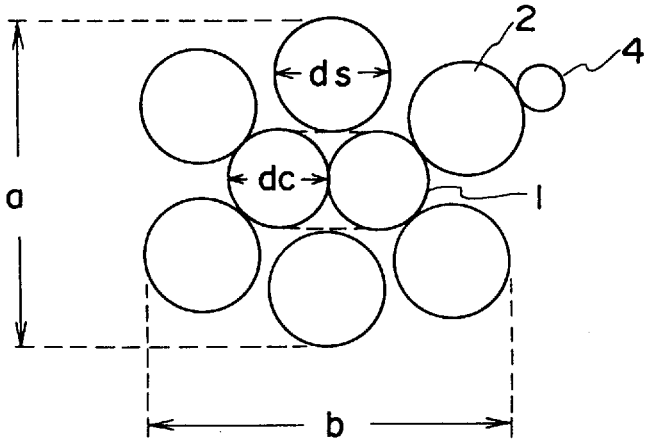
Figure 5:
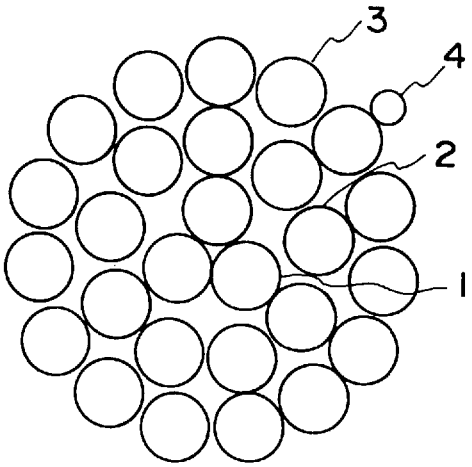
FIG. 5 PRIOR ART
FIG. 5 is a schematic diagram showing a cross section of a conventional steel cord for reinforcing rubber articles.

In examples 1 through 11, the pneumatic radial tires each having the size of 10.00R20 were manufactured by using, for the belt layer, steel cords each having the structure shown in Table 2-1 and Table 2-2 listed below, and FIGS. 1 and 2. In a conventional example, the pneumatic radial tire having the size of 10.00R20 was manufactured by using, for the belt layer, the steel cords each having the structure shown in Table 1 listed below and FIG. 5. Further, in comparative examples, the pneumatic radial tires each having the size of 10.00R20 were manufactured by using, for the belt layer, the steel cords each having the structure shown in Table 1.

Figure 3:
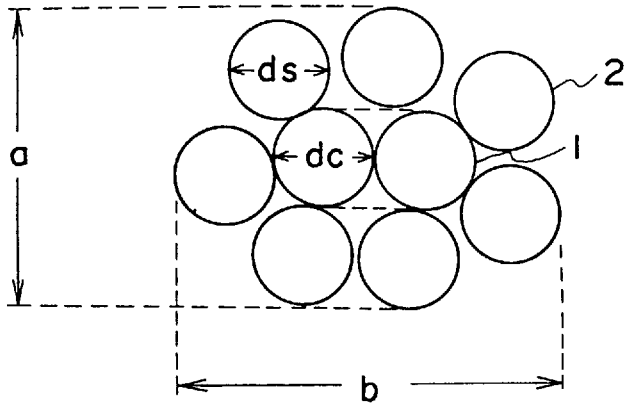
Figure 4:
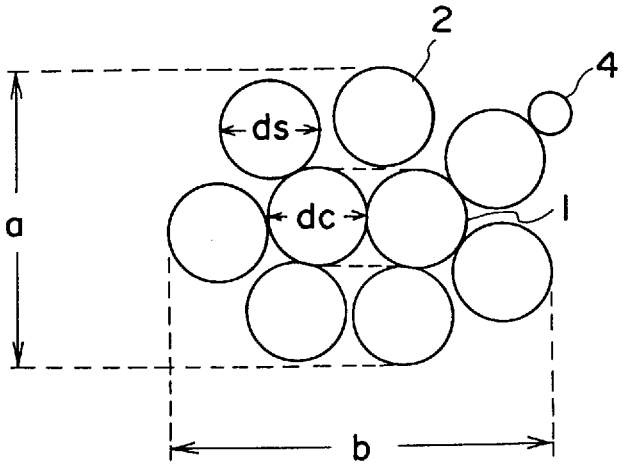

In examples 12 through 22, the pneumatic radial tires each having the size of 10.00R20 were manufactured by using, for the belt layer, steel cords each having the structure shown in Table 4-1 and Table 4-2 listed below, and FIGS. 3 and 4. In a conventional example, the pneumatic radial tire having the size of 10.00R20 was manufactured by using, for the belt layer, the steel cords each having the structure shown in Table 3 below and FIG. 5. Further, in comparative examples, the pneumatic radial tires each having the size of 10.00R20 were manufactured by using, for the belt layer, the steel cords each having the structure shown in Table 3.

The tires thus manufactured were evaluated in the following manners.

In the drawings, numeral 1 designates a core, numeral 2 designates a sheath (an intermediate sheath), numeral 3 designates an external sheath, and numeral 4 designates a spiral wire. Further, dc indicates the diameter of each filament of the core, ds indicates the diameter of each filament of the sheath a indicates the minor axis of the steel cord, and b indicates the major axis of the steel cord.

Penetrability of rubber in the inner portion of the cord

A steel cord was taken out from the belt layer of the tire, an amount of rubber adhering onto the intermediate sheath was measured through the filament of the external sheath of the steel cord, and an amount of rubber adhering onto the core was measured through the filament of the intermediate sheath. The respective amounts of rubber were evaluated and expressed in terms of %, where the state in which rubber does not in the least adhere onto the surfaces of the respective filaments is assumed to be 0%, and the state in which rubber completely adheres onto the surfaces is assumed to be 100%.

Resistance against separation

The manufactured tires were placed on ten-ton trucks and driven on a rough road to be completely worn out. The worn-out tires were dissected and existence of separation having an area of 5 $cm^2$ or greater, which is caused by corrosion of the steel cord due to propagation of water to the inner portion of the steel cord was examined.

The number of cuts through the tread

The manufactured tires were placed on ten-ton trucks and driven on the rough road to be completely worn out. The worn-out tires were dissected and the number of cuts through the tread was measured per unit area.

The results obtained from the conventional example and comparative examples 1 through 5 are given in Table 1, and the results obtained from examples 1 through 11 are given in Table 2-1 and Table 2-2. Note that, in Table 1, the first numeral of the cord structure in the conventional example indicates the number of core filaments, the second and third numerals thereof indicate the numbers of intermediate sheath filaments and external sheath filaments, respectively, and the fourth numeral indicates the number of spiral cord filaments. The first numeral of the cord structure in each of the comparative examples 1 through 5 indicates the number of core filaments and the second numeral thereof indicates the number of sheath filaments. Further, in Tables 2-1 and 2-2, the first numeral of the cord structure in each example indicates the number of core filaments, the second numeral indicates the number of sheath filaments, and the third numeral indicates the number of spiral cords.

TABLE 1

| | Conv. Ex. | Comp. Ex. 1 | Comp. Ex. 2 | Comp. Ex. 3 | Comp. Ex. 4 | Comp. Ex. 5 |
|---|---|---|---|---|---|---|
| Cord structure | 3 + 9 + 15 + 1 | 1 + 6 | 3 + 6 | 2 + 6 | 2 + 6 | 2 + 6 |
| Filament diameter (mm) | | | | | | |
| Core (dc) | 0.23 | 0.30 | 0.26 | 0.26 | 0.18 | 0.38 |
| (Intermediate) sheath (ds) | 0.23 | 0.30 | 0.34 | 0.32 | 0.32 | 0.10 |
| External sheath | 0.23 | — | — | — | — | — |
| Diameter ratio ((ds/dc) × 100) (%) | 100.0 | 100.0 | 100.8 | 88.9 | 177.8 | 26.3 |

TABLE 1-continued

| | Conv. Ex. | Comp. Ex. 1 | Comp. Ex. 2 | Comp. Ex. 3 | Comp. Ex. 4 | Comp. Ex. 5 |
|---|---|---|---|---|---|---|
| Twist pitch (mm) | | | | | | |
| Core | 6 | ∞ | 7 | 9 | 50 | 50 |
| (Intermediate) sheath | 12 | 12 | 15 | 18 | 18 | 18 |
| External sheath | 18 | — | — | — | — | — |
| Ratio of minor axis a to major axis b ((a/b) × 100)% | 100.0 | 100.0 | 100.0 | 100.00 | 100.0~82.0 | 100.0~60.4 |
| Rubber penetrability (%) | | | | | | |
| On core | 0 | 15 | 10 | 51 | 66 | 68 |
| On (intermediate) sheath | 4 | 98 | 98 | 98 | 99 | 99 |
| Existence of separations | Yes | Yes | Yes | Yes | Yes | Yes |
| Number of cuts through tread (number/$m^2$) | 135 | 122 | 138 | 118 | 63 | 66 |

Notes:
Conv. Ex.: conventional example
Comp. Ex.: comparative example

TABLE 2-1

| | Example 1 | Example 2 | Example 3 | Example 4 | Example 5 | Example 6 |
|---|---|---|---|---|---|---|
| Cord structure | 2 + 6 | 2 + 6 | 2 + 6 + 1 | 2 + 6 | 2 + 6 | 2 + 6 |
| Filament diameter (mm) | | | | | | |
| Core (dc) | 0.37 | 0.44 | 0.37 | 0.37 | 0.23 | 0.40 |
| (Intermediate) sheath (ds) | 0.37 | 0.40 | 0.37 | 0.37 | 0.37 | 0.24 |
| External sheath | — | — | — | — | — | — |
| Diameter ratio ((ds/dc) × 100) (%) | 100.0 | 90.9 | 100.0 | 100.0 | 160.9 | 60.0 |
| Twist pitch (mm) | | | | | | |
| Core | 50 | 50 | 50 | ∞ | ∞ | ∞ |
| (Intermediate) sheath | 18 | 18 | 18 | 18 | 18 | 18 |
| External sheath | — | — | — | — | — | — |
| Ratio of minor axis a to major axis b ((a/b) × 100)% | 100.0~75.0 | 100.0~73.8 | 100.0~75.0 | 75.0 | 80.6 | 68.8 |
| Rubber penetrability (%) | | | | | | |
| On core | 96 | 91 | 97 | 98 | 96 | 99 |
| On (intermediate) sheath | 99 | 99 | 99 | 99 | 99 | 99 |
| Existence of separations | No | No | No | No | No | No |
| Number of cuts through tread (number/$m^2$) | 56 | 53 | 55 | 50 | 52 | 48 |

TABLE 2-2

| | Example 7 | Example 8 | Example 9 | Example 10 | Example 11 |
|---|---|---|---|---|---|
| Cord structure | 2 + 6 | 2 + 6 | 2 + 6 | 2 + 6 | 2 + 6 |
| Filament diameter (mm) | | | | | |
| Core (dc) | 0.40 | 0.18 | 0.11 | 0.26 | 0.35 |
| (Intermediate) sheath (ds) | 0.37 | 0.11 | 0.16 | 0.26 | 0.35 |
| External sheath | — | — | — | — | — |
| Diameter ratio ((ds/dc) × 100) (%) | 92.5 | 61.1 | 136.4 | 100.0 | 100.0 |
| Twist pitch (mm) | | | | | |
| Core | 50 | 50 | ∞ | ∞ | ∞ |
| (Intermediate) sheath | 18 | 16 | 18 | 18 | 16 |
| External sheath | — | — | — | — | — |
| Ratio of minor axis a to major axis b ((a/b) × 100)% | 100.0~74.0 | 100.0~69.0 | 78.8 | 75.0 | 75.0 |
| Rubber penetrability (%) | | | | | |
| On core | 96 | 95 | 98 | 98 | 90 |
| On (intermediate) sheath | 99 | 99 | 99 | 99 | 99 |
| Existence of separations | No | No | No | No | No |
| Number of cuts through tread (number/$m^2$) | 53 | 54 | 49 | 49 | 48 |

The results obtained from the conventional example and comparative examples 6 through 10 are given in Table 3, and the results obtained from examples 12 through 22 are given in Table 4-1 and Table 4-2. Note that, in Table 3, the first numeral of the cord structure in the conventional example indicates the number of core filaments, the second and third numerals thereof indicate the numbers of intermediate sheath filaments and external sheath filaments, respectively, and the fourth numeral indicates the number of spiral cord filaments. The first numeral of the cord structure in each of the comparative examples 6 through 10 indicates the number of core filaments and the second numeral thereof indicates the number of sheath filaments. Further, in Tables 4-1 and 4-2, the first numeral of the cord structure in each example indicates the number of core filaments, the second numeral indicates the number of sheath filaments, and the third numeral indicates the number of spiral cords.

TABLE 3

| | Conv. Ex. | Comp. Ex. 6 | Comp. Ex. 7 | Comp. Ex. 8 | Comp. Ex. 9 | Comp. Ex. 10 |
|---|---|---|---|---|---|---|
| Cord structure | 3 + 9 + 15 + 1 | 1 + 7 | 3 + 7 | 2 + 7 | 2 + 7 | 2 + 7 |
| Filament diameter (mm) | | | | | | |
| Core (dc) | 0.23 | 0.36 | 0.26 | 0.36 | 0.18 | 0.38 |
| (Intermediate) sheath (ds) | 0.23 | 0.30 | 0.34 | 0.32 | 0.28 | 0.14 |
| External sheath | 0.23 | — | — | — | — | — |
| Diameter ratio ((ds/dc) × 100) (%) | 100.0 | 83.3 | 130.8 | 88.9 | 155.6 | 36.8 |
| Twist pitch (mm) | | | | | | |
| Core | 6 | ∞ | 7 | 9 | 50 | 50 |
| (Intermediate) sheath | 12 | 12 | 15 | 18 | 18 | 18 |

TABLE 3-continued

| | Conv. Ex. | Comp. Ex. 6 | Comp. Ex. 7 | Comp. Ex. 8 | Comp. Ex. 9 | Comp. Ex. 10 |
|---|---|---|---|---|---|---|
| External sheath | 18 | — | — | — | — | — |
| Ratio of minor axis a to major axis b ((a/b) × 100)% | 100.0 | 100.0 | 100.0 | 100.0 | 100.0~80.4 | 100.00~83.3 |
| Rubber penetrability (%) | | | | | | |
| On core | 0 | 65 | 10 | 51 | 66 | 68 |
| On (intermediate) sheath | 4 | 98 | 98 | 98 | 99 | 99 |
| Existence of separations | Yes | Yes | Yes | Yes | Yes | Yes |
| Number of cuts through tread (number/$m^2$) | 135 | 122 | 136 | 118 | 63 | 56 |

Notes:

Conv. Ex.: conventional example

Comp. Ex.: comparative example

TABLE 4-1

| | Example 12 | Example 13 | Example 14 | Example 15 | Example 16 | Example 17 |
|---|---|---|---|---|---|---|
| Cord structure | 2 + 7 | 2 + 7 | 2 + 7 + 1 | 2 + 7 | 2 + 7 | 2 + 7 |
| Filament diameter (mm) | | | | | | |
| Core (dc) | 0.37 | 0.44 | 0.37 | 0.37 | 0.30 | 0.40 |
| (Intermediate) sheath (ds) | 0.37 | 0.40 | 0.37 | 0.37 | 0.36 | 0.20 |
| External sheath | — | — | — | — | — | — |
| Diameter ratio ((ds/dc) × 100) (%) | 100.0 | 90.9 | 100.0 | 100.0 | 120.0 | 50.0 |
| Twist pitch (mm) | | | | | | |
| Core | 50 | 50 | 50 | ∞ | ∞ | ∞ |
| (Intermediate) sheath | 18 | 18 | 18 | 18 | 18 | 18 |
| External sheath | — | — | — | — | — | — |
| Ratio of minor axis a to major axis b ((a/b) × 100)% | 100.0~75.0 | 100.0~73.8 | 100.0~75.0 | 75.0 | 77.3 | 66.7 |
| Rubber penetrability (%) | | | | | | |
| On core | 96 | 91 | 97 | 98 | 96 | 99 |
| On (intermediate) sheath | 99 | 99 | 99 | 99 | 99 | 99 |
| Existence of separations | No | No | No | No | No | No |
| Number of cuts through tread (number/$m^2$) | 56 | 53 | 56 | 50 | 52 | 48 |

TABLE 4-2

| | Example 18 | Example 19 | Example 20 | Example 21 | Example 22 |
|---|---|---|---|---|---|
| Cord structure | 2 + 7 | 2 + 7 | 2 + 7 | 2 + 7 | 2 + 7 |
| Filament diameter (mm) | | | | | |
| Core (dc) | 0.40 | 0.22 | 0.12 | 0.28 | 0.35 |
| (Intermediate) sheath (ds) | 0.37 | 0.11 | 0.11 | 0.25 | 0.30 |
| External sheath | — | — | — | — | — |
| Diameter ratio ((ds/dc) × 100) (%) | 92.5 | 50.0 | 91.7 | 80.3 | 85.7 |
| Twist pitch (mm) | | | | | |
| Core | 50 | 60 | ∞ | ∞ | ∞ |
| (Intermediate) sheath | 18 | 16 | 18 | 18 | 16 |
| External sheath | — | — | — | — | — |
| Ratio of minor axis a to major axis b ((a/b) × 100)% | 100.0~74.0 | 100.0~66.7 | 73.9 | 73.6 | 73.1 |
| Rubber penetrability (%) | | | | | |
| On core | 96 | 95 | 98 | 98 | 99 |
| On (intermediate) sheath | 99 | 99 | 99 | 99 | 99 |
| Existence of separations | No | No | No | No | No |
| Number of cuts through tread (number/$m^2$) | 53 | 54 | 49 | 49 | 48 |

According to the present invention, the steel cords for reinforcing rubber articles, of which resistance against propagation of corrosion and productivity are remarkably improved, can be obtained, and the pneumatic radial tire in which the above steel cords are applied to the belt layer has an excellent penetrability of rubber into the inner portion of each cord, thereby resulting in the durability thereof being improved.

What is claimed is:

1. A two-layered twisted steel cord for reinforcing rubber articles, comprising; a core including two filaments and a sheath including six or seven filaments wound around the core, wherein an average twist pitch of the core is at least 30 mm, and when six filaments are used for the sheath, a ratio of diameter ds of each filament of the sheath to diameter dc of each filament of the core, [(ds/dc)×100], is in a range of 58.0%<ds/dc<161.5%, and when seven filaments are used for the sheath, the ratio of diameter ds to diameter dc is in a range of 47.3%<ds/dc<121.1%, and wherein when six filaments are used for the sheath, a ratio of a minor axis a of said steel cord to a major axis b, in cross-section [(a/b)×100], is set in a range of 100.0%≧a/b>68.4%.

2. A two-layered twisted steel cord for reinforcing rubber articles according to claim 1, wherein the diameter dc of each of filaments which form the core is in a range of 0.10 mm≦dc≦0.40 mm and the diameter ds of each of filaments which form the sheath is in a range of 0.10 mm≦ds≦0.37 mm.

3. A two-layered twisted steel cord for reinforcing rubber articles, consisting of a core including two filaments and a sheath including six or seven filaments wound around the core, wherein the filaments which form the core are untwisted, and when six filaments are used for the sheath, a ratio of diameter ds of each filament of the sheath to diameter dc of each filament of the core, [(ds/dc)×100], is in a range of 58.0%<ds/dc<161.5%, and when seven filaments are used for the sheath, the ratio of diameter ds to diameter dc is in a range of 47.3%<ds/dc<121.1%.

4. A two-layered twisted steel cord for reinforcing rubber articles according to claim 3, wherein when six filaments are used for the sheath, a ratio of a minor axis a of said steel cord to a major axis b, in cross-section [(a/b)×100], is in a range of 100.0%≧a/b>68.4%.

5. A two-layered twisted steel cord for reinforcing rubber articles according to claim 4, wherein the diameter dc of each of filaments which form the core is in a range of 0.10 mm≦dc≦0.40 mm and the diameter ds of each of filaments which form the sheath is in a range of 0.10 mm≦ds≦0.37 mm.

6. A two-layered twisted steel cord for reinforcing rubber articles according to claim 3, wherein when seven filaments are used for the sheath, a ratio of a minor axis a of said steel cord to a major axis b, in cross-section [(a/b)×100], is set in a range of 100.0%≧a/b>66.1%.

7. A two-layered twisted steel cord for reinforcing rubber articles according to claim 6, wherein the diameter dc of each of filaments which form the core is in a range of 0.10 mm≦dc≦0.40 mm and the diameter ds of each of filaments which form the sheath is in a range of 0.10 mm≦ds≦0.37 mm.

8. A pneumatic radial tire in which steel cords are used as cords for forming a carcass or a belt layer, each of said steel cords being a two-layered twisted steel cord for reinforcing rubber articles and comprising, a core including two filaments and a sheath including six or seven filaments wound around the core, wherein an average twist pitch of the core is at least 30 mm, and when six filaments are used for the sheath, a ratio of diameter ds of each filament of the sheath to diameter dc of each filament of the core, [(ds/dc)×100], is in a range of 58.0%<ds/dc<161.5%, and when seven filaments are used for the sheath, the ratio of diameter ds to diameter dc is in a range of 47.3%<ds/dc<121.1%; and in the two-layered twisted steel cords for reinforcing rubber articles, when six filaments are used for the sheath a ratio of a minor axis a of each of said steel cords to a major axis b in cross section, [(a/b)×100], is in a range of 100.0%≧a/b>68.4%.

9. A pneumatic radial tire according to claim 8, comprising the two-layered twisted steel cords for reinforcing rubber articles, in which the diameter dc of each of filaments which form the core is in a range of 0.10 mm≦dc≦0.40 mm and the diameter ds of each of filaments which form the sheath is in a range of 0.10 mm≦ds≦0.37 mm.

10. A pneumatic radial tire in which steel cords are used as cords for forming a carcass or a belt layer, each of said steel cords being a two-layered twisted steel cord for reinforcing rubber articles and consisting of a core including two filaments and a sheath including six or seven filaments wound around the core, wherein the filaments which form the core are untwisted, and when six filaments are used for the sheath, a ratio of diameter ds of each filament of the sheath to diameter dc of each filament of the core, [(ds/dc)×100], is in a range of 58.0%<ds/dc<161.5%, and when seven filaments are used for the sheath, the ratio of diameter ds to diameter dc is in a range of 47.3%<ds/dc<121.1%.

11. A pneumatic radial tire according to claim 10, comprising the two-layered twisted steel cords for reinforcing rubber articles, in which when six filaments are used for the sheath, a ratio of a minor axis a of each of said steel cords to a major axis b, [(a/b)×100], is set in a range of 100.0%≧a/b>68.4%.

12. A pneumatic radial tire according to claim 11, consisting of the two-layered twisted steel cords for reinforcing rubber articles, in which the diameter dc of each of filaments which form the core is in a range of 0.10 mm≦dc≦0.40 mm and the diameter ds of each of filaments which form the sheath is in a range of 0.10 mm≦ds≦0.37 mm.

13. A pneumatic radial tire according to claim 10, comprising the two-layered twisted steel cords for reinforcing rubber articles, in which when seven filaments are used for the sheath, a ratio of a major axis a of each of said steel cords to a minor axis b, [(a/b)×100], is in a range of 100.0%≧a/b>66.1%.

14. A pneumatic radial tire according to claim 13, consisting of the two-layered twisted steel cords for reinforcing rubber articles, in which the diameter dc of each of filaments which form the core is in a range of 0.10 mm≦dc≦0.40 mm and the diameter ds of each of filaments which form the sheath is in a range of 0.10 mm≦ds≦0.37 mm.

15. A two-layered twisted steel cord for reinforcing rubber articles, comprising; a core including two filaments and a sheath including six or seven filaments wound around the core, wherein an average twist pitch of the core is at least 30 mm, and when six filaments are used for the sheath, a ratio of diameter ds of each filament of the sheath to diameter dc of each filament of the core, [(ds/dc)×100], is in a range of 58.0%<ds/dc<161.5%, and when seven filaments are used for the sheath, the ratio of diameter ds to diameter dc is in a range of 47.3%<ds/dc<121.1%, wherein when seven filaments are used for the sheath, a ratio of a minor axis a of said steel cord to a major axis b in cross-section, [(a/b)×100], is set in a range of 100.0%≧a/b>66.1%.

16. A two-layered twisted steel cord for reinforcing rubber articles according to claim 15, wherein the diameter dc of each of filaments which form the core is in a range of 0.10 mm≦dc≦0.40 mm and the diameter ds of each of filaments which form the sheath is in a range of 0.10 mm≦ds≦0.37 mm.

17. A pneumatic radial tire in which steel cords are used as cords for forming a carcass or a belt layer, each of said steel cords being a two-layered twisted steel cord for reinforcing rubber articles and comprising; a core including two filaments and a sheath including six or seven filaments wound around the core, wherein an average twist pitch of the core is at least 30 mm, and when six filaments are used for the sheath, a ratio of diameter ds of each filament of the sheath to diameter dc of each filament of the core, [(ds/dc)×100], is in a range of 58.0%<ds/dc<161.5%, and when seven filaments are used for the sheath, the ratio of diameter ds to diameter dc is in a range of 47.3%<ds/dc<121.1%; and in the two-layered twisted steel cords for reinforcing rubber articles, when seven filaments are used for the sheath a ratio of a minor axis a of each of said steel cords to a major axis b in cross section, [(a/b)×100], is in a range of 100.0%≧a/b>66.1%.

18. A pneumatic radial tire according to claim 17, comprising the two-layered twisted steel cords for reinforcing rubber articles, in which the diameter dc of each of filaments which form the core is in a range of 0.10 mm≦dc≦0.40 mm and the diameter ds of each of filaments which form the sheath is in a range of 0.10 mm≦ds≦0.37 mm.

* * * * *